US005187415A

United States Patent [19]

Osawa et al.

[11] Patent Number: 5,187,415

[45] Date of Patent: Feb. 16, 1993

[54] LOW-PRESSURE RARE GAS DISCHARGE LAMP AND METHOD FOR LIGHTING SAME

[75] Inventors: Takashi Osawa; Katsuo Murakami; Seishiro Mitsuhashi; Yujiro Kamano; Toshihiko Kobayashi, all of Kamakura, Japan

[73] Assignee: Mitsubishi Denki Kabushiki Kaisha, Tokyo, Japan

[21] Appl. No.: 538,084

[22] Filed: Jun. 13, 1990

[30] Foreign Application Priority Data

Jun. 13, 1989 [JP] Japan ..... 1-150254
Jun. 16, 1989 [JP] Japan ..... 1-154214
Jul. 5, 1989 [JP] Japan ..... 1-173207

[51] Int. Cl.[5] ..... H01J 61/067

[52] U.S. Cl. ..... 313/326; 313/489; 313/577; 313/635; 313/643; 427/106; 427/126.3

[58] Field of Search ..... 315/326, 101, 58; 427/106, 126.3, 230; 313/489, 635, 643, 577

[56] References Cited

U.S. PATENT DOCUMENTS 3,624,444 11/1971 Berthold et al. ..... 313/489 X
3,748,518 7/1973 Lewis ..... 313/489
3,875,454 4/1975 Van Der Wolf et al. ..... 313/488
3,875,455 4/1975 Kaduk et al. ..... 313/489
3,912,828 10/1975 Olwert ..... 427/67
3,984,589 10/1976 Van Der Wolfe et al. ..... 427/106
4,500,810 2/1985 Graff ..... 313/489 X
4,882,520 11/1989 Tsunekawa et al. ..... 313/489 X
4,914,347 4/1990 Osawa et al. ..... 313/643 X
4,924,141 5/1990 Taubner et al. ..... 313/489 X
5,008,789 4/1991 Arai et al. ..... 313/635 X
5,034,661 7/1991 Sakurai et al. ..... 315/226 X

FOREIGN PATENT DOCUMENTS 314121 5/1989 European Pat. Off. .
328689 8/1989 European Pat. Off. .
8902160 3/1989 World Int. Prop. O. .

*Primary Examiner*—Eugene R. LaRoche
*Assistant Examiner*—Do Hyum Yoo
*Attorney, Agent, or Firm*—Oblon, Spivak, McClelland, Maier & Neustadt

[57] ABSTRACT

A low-pressure rare gas discharge lamp wherein a light emitting gas composed substantially 100% of rare gases is sealed in a bulb and light emitted is from the gas by electric discharge. An isolation film for the light emitting gas from the bulb is provided at least on the inner surface portion of the bulb which portion surrounds a positive column. In another embodiment, a hot cathode type low-pressure rare gas discharging fluorescent lamp includes a glass bulb, a pair of electrodes including an electrode acting as a hot cathode at least in a stable discharging state, the paired electrodes being provided within the glass bulb, a fluorescent substance layer formed on the inner surface of the glass bulb, and a light emitting gas sealed in the interior of the glass bulb. The fluorescent substance layer is rendered luminous by radiation emitted from the light emitting gas. A partial pressure of the sealed, light emitting gas is not higher than 5 Torr, and the light emitting gas includes at least krypton.

2 Claims, 5 Drawing Sheets

LOW-PRESSURE RARE GAS DISCHARGE LAMP AND METHOD FOR LIGHTING SAME

BACKGROUND OF THE INVENTION

The present invention relates to a low-pressure rare gas discharge lamp with a rare gas sealed therein as a light emitting gas. Particularly, the present invention is concerned with a low-pressure rare gas discharging fluorescent lamp for use in office automatic (OA)-related machinery and apparatus such as facsimiles and copying machines.

As the prior art, for example on pages 1079–1082 of "Toshiba Review", Vol. 40, No. 12 (1985) there is described a low-pressure rare gas discharge lamp with several ten Torr to several hundred Torr of xenon sealed therein in place of mercury used in ordinary fluorescent lamps. More particularly, since mercury vapor is used in ordinary fluorescent lamps, this vapor pressure changes with change of the ambient temperature, and light output also varies, while the use of xenon is advantageous in that the light output does not vary over a wide temperature range because mercury is not used. This advantage is utilized to attain the extension of use as a light source for OA-related machinery and apparatus.

On the other hand, for example, as reported by Mr. Okuno of Matsushita Electric Industrial Co., Ltd. at the 1975 national meeting of the illumination society, it is known that in a xenon-sealed low-pressure rare gas discharge lamp, the best light emitting efficiency is realized by making the sealed gas pressure extremely low, not higher than 0.1 Torr. However, as also pointed out by the same report, there has been the problem that in such a low pressure region, xenon is extinguished by a clean-up phenomenon during discharge and the service life of the lamp expires in a short time.

Thus, in a low-pressure gas discharge lamp, if the sealed gas pressure is set low, there will be an increase of luminance and improvement of efficiency, but the life of the lamp will expire in an extremely short time due to a clean-up phenomenon. Therefore, in order to ensure the service life of the lamp it has inevitably been required to increase the gas pressure under the sacrifice of luminance and efficiency.

SUMMARY OF THE INVENTION

The present invention has been accomplished for overcoming the above-mentioned problems. According to our finding, the clean-up phenomenon of a low-pressure rare gas discharge lamp is closely related to the relation between the residue in the glass tube and rare gas ion, and this reaction is suppressed by isolating the rare gas ion and the residue in the glass tube from each other. The present invention is based on this finding and it is the object thereof to provide a low-pressure rare gas discharge lamp capable of preventing the clean-up phenomenon even at an extremely low pressure of a rare gas sealed in the lamp and having high luminance and efficiency and a prolonged service life in a low gas pressure region.

In a low-pressure rare gas discharge lamp according to the present invention, an isolation film for isolation of the light emitting gas in a discharge space is provided at least on the inner surface portion of the bulb which portion surrounds a positive column.

DETAILED DESCRIPTION OF THE PREFERRED EMBODIMENTS

Preferred embodiments of the present invention will be described with reference to the drawings.

Figure 1:
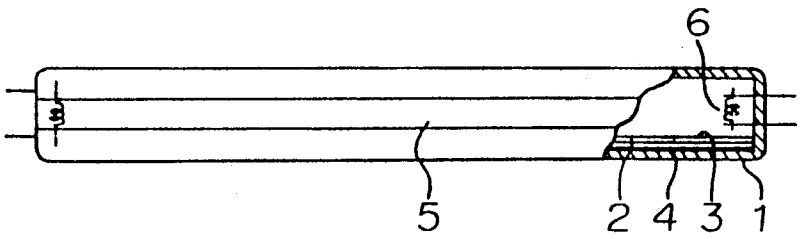
FIG. 1 is a partially sectional view showing an embodiment of the present invention.

In FIG. 1, which is a partially sectional view of a low-pressure rare gas discharge lamp according to an embodiment of the present invention, a reference numeral 1 denotes a gas bulb having a tube diameter of 15.5 mm. The glass bulb 1 is formed by soda glass which is very common and in which there are contained as residues about 0.004 wt% of fluorine and 0.031% of chlorine. A numeral 2 denotes a titanium oxide film formed as an isolation film on the inner surface of the glass bulb 1. The titanium oxide film 2 is formed by applying tetrabutyl titanate to the bulb inner surface, then drying and baking it for decomposition. A numeral 3 denotes a fluorescent substance layer formed on a face of the titanium oxide film 2, using $GP_1G_1$ green fluorescent substance (a product of Kasei Optonix, Ltd.). Numerals 4, 5 and 6 denote a reflective film, an aperture, and a filament, respectively. Though not shown in the figure, an electron emitting substance is applied to the filament 6, and xenon 100% gas is sealed in the interior of the glass bulb 1. In the glass bulb 1, moreover, there is provided a sufficient amount of barium getter for the purpose of adsorbing impure gases throughout the service life of the lamp. As to lighting conditions, a sinusoidal high frequency of 30 KHz was used as a power source, and the lamp current was set constant at 100 mA.

Figure 2:
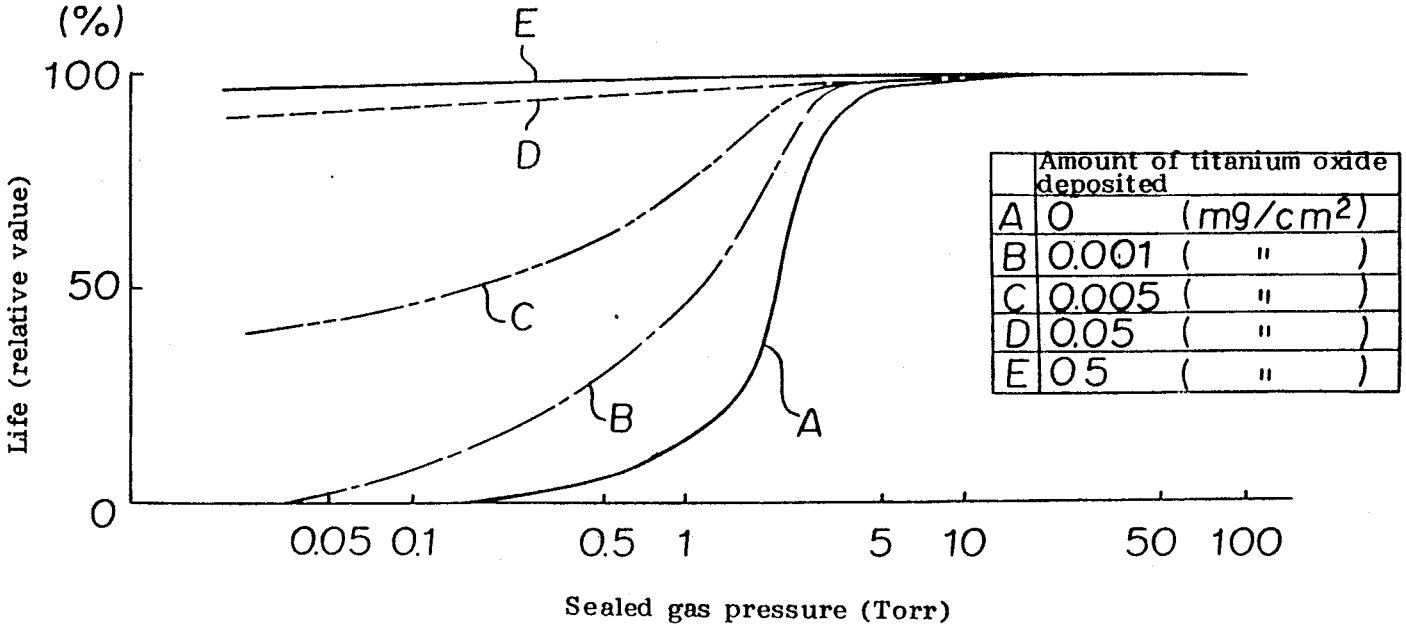
FIG. 2 is a life characteristic diagram of a low-pressure rare gas discharge lamp using a titanium oxide film.

FIG. 2 shows life characteristics in varied gas pressures in the lamp constructed as above, in which the amount of titanium oxide deposited on the inner surface of the glass bulb is used as a parameter. The life is shown in terms of a relative value, assuming that the life of the lamp having a sealed xenon pressure of 100 Torr is 100%. Reference to the figure shows that as the amount of titanium oxide deposited increases, the life of the lamp is prolonged to a remarkable extent. When the filaments of lamps whose lives had expired were observed, there scarcely remained an electron emitting substance in lamps in which the amount of titanium oxide deposited exceeded 0.05 mg/cm$^2$. This state was close to that of the filaments of lamps each having a sealed gas pressure of 50 Torr or higher and with titanium oxide not deposited.

According to another similar experiment, krypton proved to make the lamp life shorter than in the use of xenon. Generally, rare gases are called inert gases which are extremely small in reactivity, and it is said that this tendency is enhanced with reduction in size of atoms. However, according to experiments made by the present inventors, smaller atoms were more apt to react in plasma. This is presumed to be because krypton is higher in the ionization level than xenon so the electron energy of krypton is higher than that of xenon during discharge and hence the reaction is accelerated. Likewise, when xenon 100% gas and xenon 10% plus neon 90% gas were sealed respectively in discharge lamps at the same pressure, the latter was higher in both electronic energy and luminance, but was shorter in the service life. Table 1 below shows several experimental examples.

TABLE 1

| (conditions) | Material of isolation film | Amount of deposition mg/cm$^2$ | Life (relative value) |
|---|---|---|---|
| 1. Product of the present invention (A) | Titanium oxide | 0.005 | 30 |
| 2. Product of the present invention (B) | Titanium oxide | 0.005 | 20 |
| 3. Comparative Example (A) | Aluminum oxide | 0.010 | 2 |
| 4. Comparative Example (A) | Silicon oxide | 0.008 | 1 |
| 5. Comparative Example (A) | Not used | — | 3 |
| 6. Comparative Example (B) | Not used | — | 1 |

Condition A:
No reflective film, applied to the whole surface of only fluorescent substance. Sealed gas composition (Xe 10%, Ne 90%) Sealed gas pressure 1.0 Torr.
Condition B:
Reflective film aperture of fluorescent substance. Sealed gas composition (Kr 10%, Ne 90%) Sealed gas pressure 1.0 Torr.

In Table 1, as the aluminum oxide and silicon oxide there were used Aluminum Oxide C (a product of DEGUSSA AG), etc., but these materials used not only were ineffective but also showed a tendency to somewhat shortening the service life of the lamps. This is presumed to be because not only the function as an isolation film, namely glass shield, is imperfect but also fine particles of the materials scratches the inner surface of the glass bulb, causing impurities (residues) in the glass to be exposed.

It is known to form a coating of titanium oxide on the inner surface of a glass bulb, as shown, for example, in Japanese Examined Patent Publication No. 7240/1961 and Japanese Unexamined Patent Publication No. 35967/1975. However, the coatings disclosed therein are for suppressing the reaction between an electroconductive film formed on the inner surface of the glass bulb and mercury. On the other hand, in Japanese Unexamined Patent Publication No. 93184/1977 there is disclosed a titanium oxide coating for suppressing the deposition of sodium in glass to prevent the reaction of sodium with mercury. Thus, all of the above conventional titanium oxide coatings are for suppressing the reaction with mercury to improve luminous flux. It is not suggested thereby at all that in a low pressure region of a rare gas discharge lamp not containing mercury, a titanium oxide film suppresses the reaction between the residues in glass and the rare gas ions to greatly improve the life characteristic.

In the present invention, as set forth above, since an isolation film is formed on the inner surface of a glass bulb which surrounds a positive column, it is possible to suppress the reaction between a light emitting gas and the residues in the glass bulb which causes the clean-up phenomenon, whereby the life of the lamp can be prolonged. Consequently, the luminance and efficiency can be greatly improved without impairing the life of the lamp.

Figure 3:
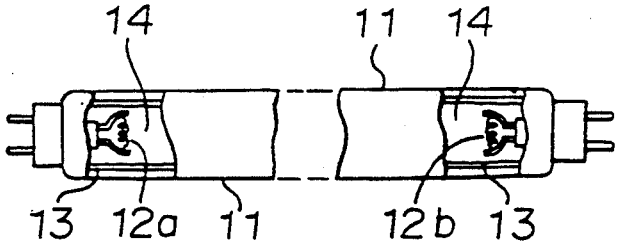
FIG. 3 is a partially sectional outline view of a hot cathode type low-pressure rare gas discharging fluorescent lamp according to another embodiment of the present invention.

Another embodiment of the present invention will be described below with reference to FIGS. 3 to 7. FIG. 3 is a partially sectional outline view of a hot cathode type low-pressure rare gas discharging fluorescent lamp embodying the present invention.

Before describing this embodiment, an explanation will now be given about problems involved in the prior art. Heretofore, a high luminance glow lamp having sealed therein a gas containing xenon (Xe) as a main component for example has been made public. This is a cold cathode type rare gas discharging fluorescent lamp in which a fluorescent substance is excited by ultraviolet ray emitted by glow discharge of the intratube Xe gas to emit light. This lamp is advantageous in that it can afford a stable light output over a wide temperature range without using mercury and also can afford light source colors according to uses by changing fluorescent substances from one to another.

Figure 4:
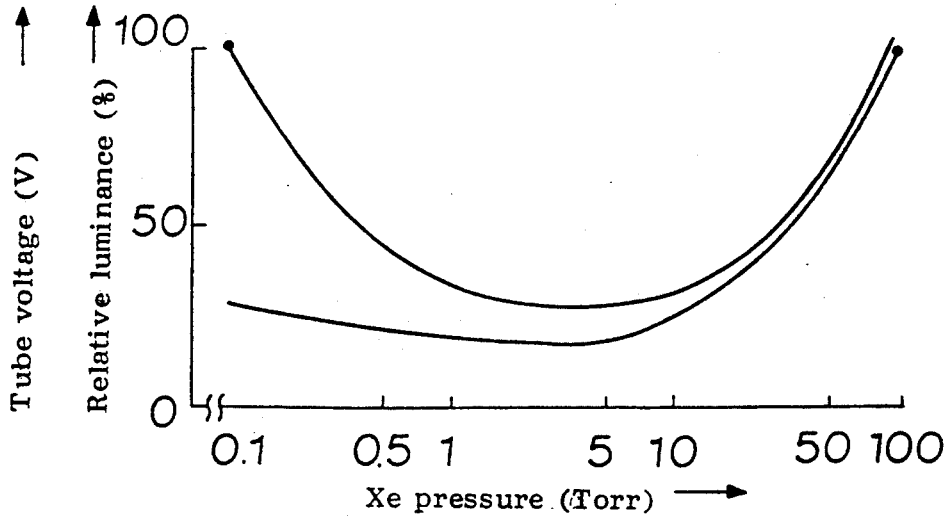
FIG. 4 is a characteristic diagram of a sealed xenon 100% gas discharging fluorescent lamp.

However, this cold cathode type rare gas discharging fluorescent lamp requires a high voltage for lighting the lamp, so there has been some problem in its handling. In view of this point the present inventors have studied a hot cathode type rare gas discharging fluorescent lamp capable of being turned ON at a low voltage and involving few problems related to high voltage. As a result, we confirmed that the light output of such hot cathode type rare gas discharging fluorescent lamp qualitatively has such a characteristic as shown in FIG. 4. This lamp, having a tube diameter of 15.5 mm, is turned ON using both hot cathodes and an AC sine wave of 30 kHz, in which the tube current is kept constant at 100 mA and 100% Xe is used as sealed gas. As is seen from the figure, the luminance is the lowest at a Xe pressure of 5 Torr or so. The luminance can be improved by either reducing the sealed gas pressure or, conversely, increasing it. When the sealed gas pressure is reduced, the increase of the tube voltage is not so rapid, but conversely when the sealed gas pressure is increased, the tube voltage also increases rapidly. More specifically, electrical characteristics of the lamp exhibit greatly different tendencies with a gas pressure of 5 Torr or so as a turning point. The present inventors conducted experiments in which Xe was used as a light emitting gas and the proportion thereof was fixed at 10%, while the gas of the balance 90% was changed using He, Ne, Ar and Kr. As a result, under the same sealed gas pressure of about 1 Torr, the luminance lowered in the order to He, Ne, Ar and Kr. Further, when there was used a gaseous mixture of, say, Xe and Ne and the proportion of Xe was increased, the luminance lowered under the same sealed gas pressure of about 1 Torr. These are in the gas pressure region of 1 Torr or so, not higher than 5 Torr, but this region is an effective region conforming to the purpose of reducing the tube voltage. and in the higher gas pressure region there occurred a different phenomenon, reference to which is here omitted because it is outside the object of the invention. The sealed gas pressure which affords the lowest luminance in the case of using a gaseous mixture shifts to a higher pressure side, i.e., a higher pressure than about 5 Torr, with decrease of the proportion of Xe, but approximately in all of the cases experimented the partial pressures of Xe were about 5 Torr. A qualitative explanation of Xe discharge fluorescent lamps has been made above. From the purpose of attaining a high luminance, low voltage lamp the present inventors have made studies about a lamp in which a partial pressure of Xe is not higher than 5 Torr.

Figure 5:
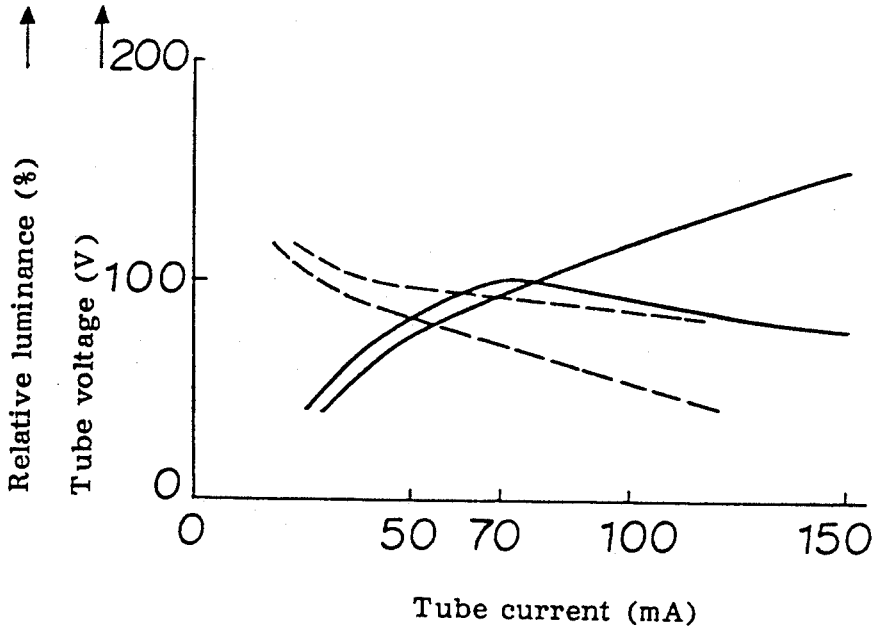
FIG. 5 is a characteristic comparison diagram of low-pressure rare gas discharging fluorescent lamps.

Here, the region in which a partial pressure of Xe is not higher than 5 Torr is assumed to be a low pressure region, and the region in which such partial pressure is above 5 Torr is assumed to be a medium pressure region. Through our study about low pressure Xe discharge it turned out that in the low pressure region there was a serious problem against the realization of higher luminance. For example, in order to simplify the problem and explain it qualitatively, consideration is here given to the case where 100% Xe gas is to be sealed in a lamp, although actually the use of a mixture thereof with another gas affords higher luminance. In this case, in a lamp of the medium pressure region, the luminance increases with increase of the tube current, while in a lamp of the low pressure region, with a certain tube current value as a turning point, the increase of the tube current results in decrease of the luminance. More particularly, as shown in FIG. 5, a maximum luminance value is obtained at a tube current of about 70 mA, and a higher luminance value is not obtained even if the tube current is varied. This problem is not encounted in the lamp of the medium pressure region.

The present invention has been accomplished for overcoming the above-mentioned problem, and it is an object thereof to provide a hot cathode type low-pressure rare gas discharging fluorescent lamp which does not involve a rapid increase of the tube voltage in the increase of luminance as in the medium pressure region and whose luminance does not reach saturation under the increase of the tube current which was explained above.

The hot cathode type low-pressure rare gas discharging fluorescent lamp embodying the invention intends to achieve the above-mentioned object by adopting the construction wherein a pair of electrodes including an electrode acting as hot cathode at least in a stable discharging state are provided in a glass bulb; a fluorescent substance layer is formed on the inner surface of the glass bulb; further, a light emitting gas is sealed in the interior of the glass bulb; a partial pressure of the sealed light emitting gas is not higher than 5 Torr, the said fluorescent substance layer being rendered luminous by radiation of the light emitting gas; and the light emitting gas includes at least krypton.

The hot cathode type low-pressure rare gas discharging fluorescent lamp illustrated in FIG. 3 according to the present invention will be described below.

In FIG. 3, a numeral 11 denotes a glass bulb having a tube diameter of 8 mm. In the interior of the glass bulb 11 there are disposed a pair of electrodes 12*a* and 12*b*, which are constituted by triple filament coils with an electron emitting substance applied thereto, the coils serving as hot cathodes at least in a stable discharging state. The distance between both electrodes is set at 280 mm.

On the inner surface of the glass bulb 11 there is formed a fluorescent substance layer 13. As the fluorescent substance there is used terbium-activated yttrium silicate represented by $Y_2SiO_5/Tb$. Further, Kr 100% light emitting gas 14 is sealed in the interior of the bulb 11 at a pressure of 0.1 Torr.

Now, the performance of this embodiment will be described in comparison with a lamp having the same size and structure as in this embodiment and with Xe 100% gas sealed as a light emitting gas at a pressure of 0.1 Torr.

Under varying tube currents of these two kinds of fluorescent lamps, the central portions of the lamps were measured for luminance by means of a luminance meter (a product of Minolta Camera Co., Ltd.). The results are as shown in FIG. 5.

Figure 6:
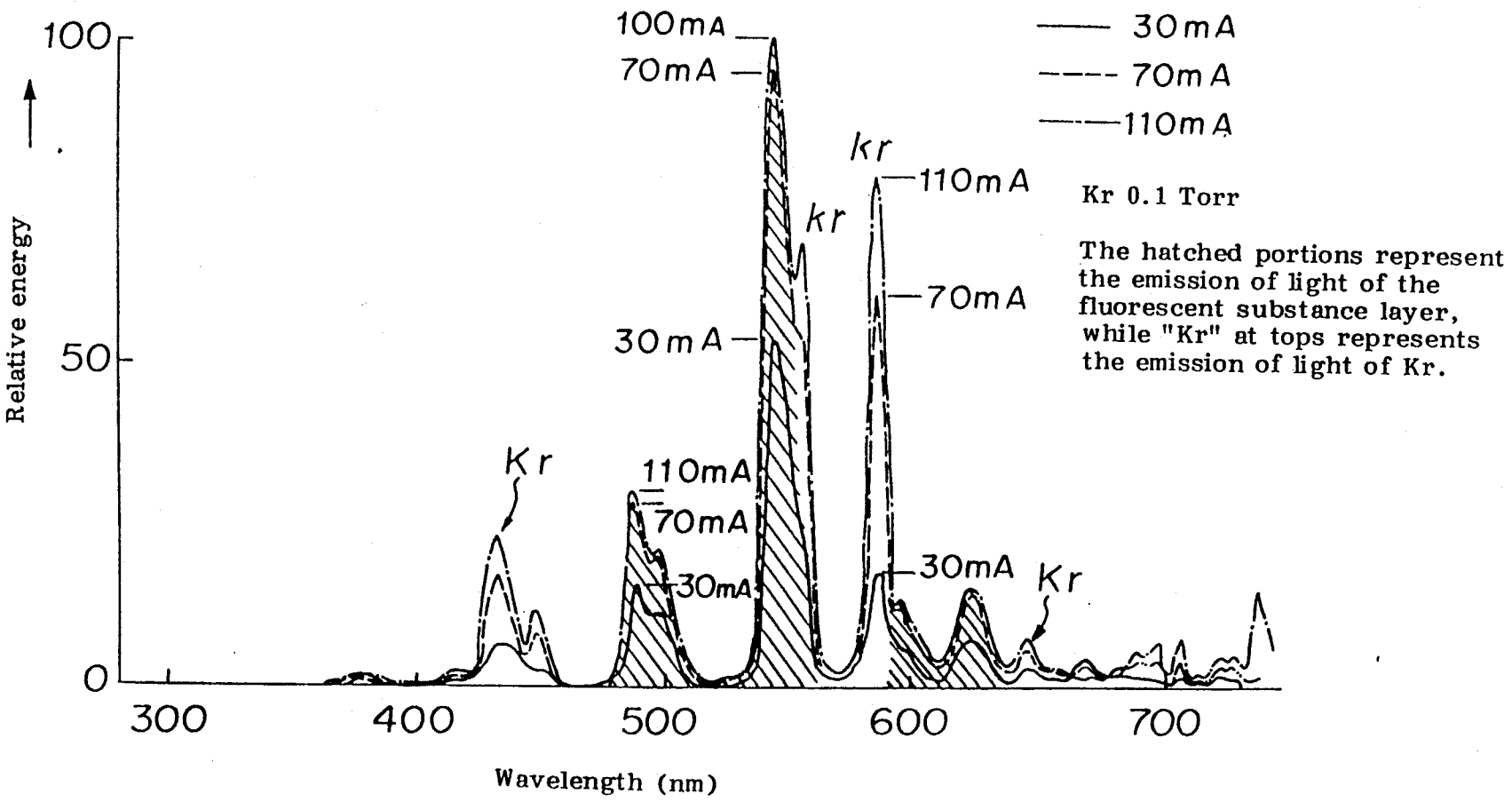
FIG. 6 is a spectral distribution diagram of a 0.1 Torr Kr 100% discharging fluorescent lamp according to the present invention.

The values of luminance were expressed in terms of relative values, assuming that the value of the tube current 70 mA of the Xe 100%, 0.1 Torr lamp was 100. Up to the tube current of 80 mA or so, the Xe 100%, 0.1 Torr lamp is higher in luminance, but at larger tube current values the Xe sealed lamp becomes lower in its luminance, while the Kr 100%, 0.1 Torr lamp does not exhibit a tendency to saturation of its luminance. This Kr 100%, 0.1 Torr lamp was checked for spectral distribution, and the results obtained are as shown in FIG. 6. In FIG. 6, the solid line, dotted line and dot-dash line represent spectral distributions at tube currents of 30 mA, 70 mA and 110 mA, respectively. In the figure, the hatched portions represent the emission of light of the fluorescent substance, while the portions indicated "Kr" represent the emission of light of Kr. As is seen from the figure, the emission of light of the fluorescent substance is saturated at a tube current of about 70 mA and is not so increased even at a tube current of 110 mA, while the atomic light emissions of Kr at 557 nm, 585 nm, 432 nm and 447 nm each exhibit an increase with increase of the tube current.

The saturation in the luminance of Xe is presumed to be because a vacuum ultraviolet ray of Xe which excites the fluorescent substance is saturated. It appears that the increase of the lamp input results in infrared emission of Xe and that this is also true of Kr. But the difference from Xe is that Kr has many spectra in the visible region. The emission of light thereof increases with increase of the lamp input. Therefore, it can be estimated that even if the light output of the fluorescent substance is saturated, the Kr lamp exhibits such effect as shown in FIG. 5 because the atomic light emission of Kr increases in the visible region.

The above is an embodiment using Kr 100%, but also when experiments were made using He, Ne and Ar as buffer gases, there were obtained similar effects.

Although the glass bulb used in this embodiment is in the shape of a straight tube, this does not constitute any limitation. The glass bulb may be in any of other shapes, including annular and U shapes.

Figure 7:
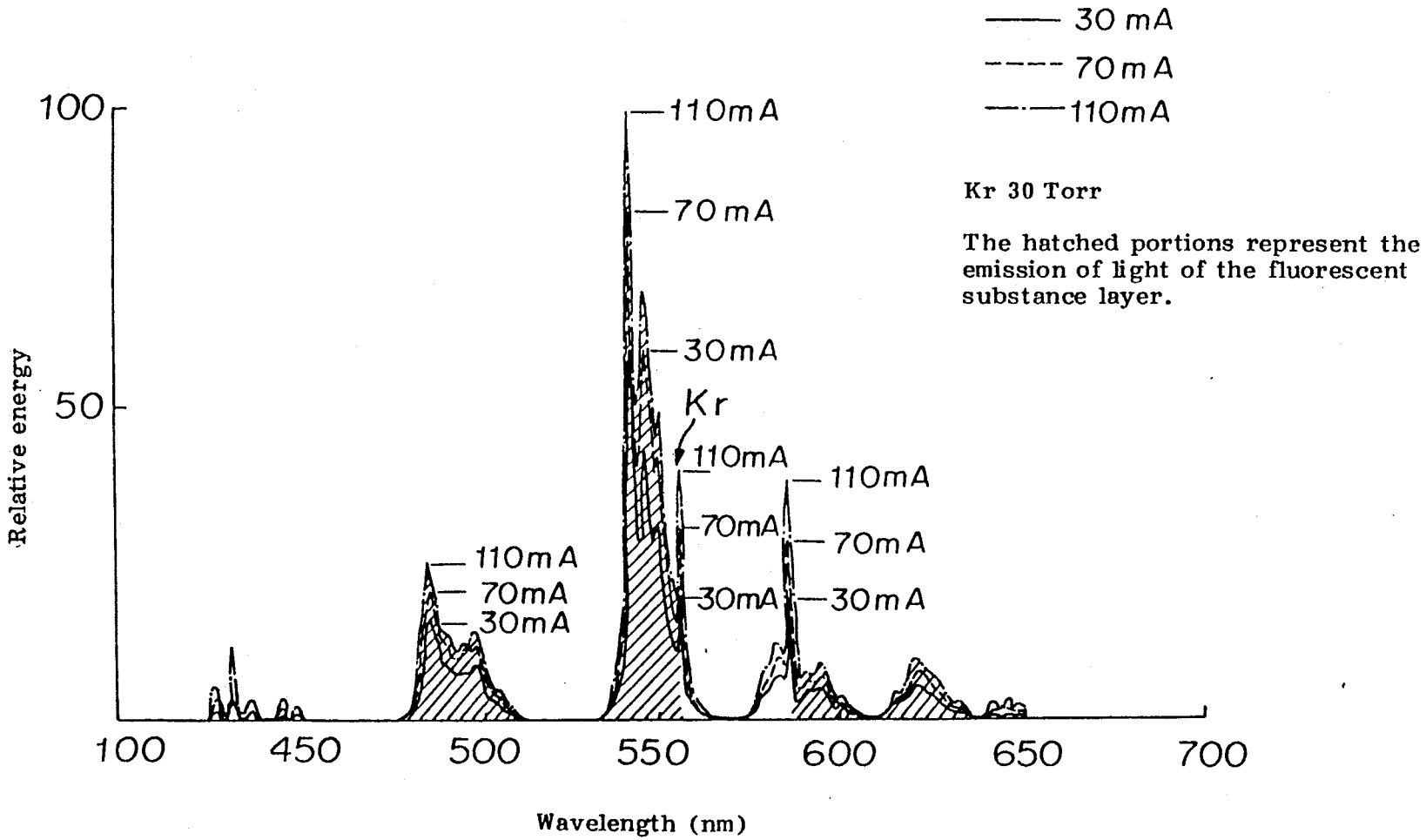
FIG. 7 is a spectral distribution diagram of a 30 Torr Kr 100% discharging fluorescent lamp.

For reference, spectral distributions of a Kr 100%, 30 Torr lamp are illustrated in FIG. 7. As is apparent from this figure, the emission of light of the fluorescent substance itself increases with increase of the tube current, thus exhibiting a characteristic different from that in the low pressure region.

According to the hot cathode type low-pressure rare gas discharging fluorescent lamp of the present invention, as set forth above, the light emitting gas sealed in the lamp is at least Krypton (Kr) and a partial pressure thereof is set at 5 Torr or lower, so as the tube current increases, the luminance is enhanced by the emission of light of the fluorescent substance layer plus the increase of the atomic light emission in the visible region of Kr. Even when the emmission of light of the fluorescent substance layer is saturated with further increase of the tube current, the atomic light emission in the visible region of Kr increases, thereby permitting the luminance to be enhanced. Besides, even when the luminance is enhanced, there will be no rapid increase of the tube voltage. In addition, since the lighting voltage is low, there can be provided a hot cathode type low-pressure rare gas discharging fluorescent lamp which involves no problem in handling as compared with high-pressure discharge lamps.

The following description is now provided about an example of a lighting method for a low-pressure rare gas discharge lamp.

Conventional low-pressure mercury vapor discharge lamps are turned ON by commercial frequencies (50 and 60 Hz). For example, as reported in the 1985 national meeting of the illumination society, it is known that if the lighting is performed using AC, high frequency, the efficiency and light output are improved. However, this degree of improvement was still insufficient for use as a light source in industrial application machinery and apparatus. Further, as to the mercury vapor discharge lamps in question, studies have also been made about lighting the lamps using a direct current for preventing flicker at end portions. For example, desk lamps of this type have already been commercialized. In this type of lamps, however, a continuous lighting of the lamp results in mercury ions shifting to the cathode side, and hence the mercury ions on the anode side become too small in quantity. Consequently, the anode-cathode luminance distribution becomes unbalanced, causing the so-called cataphoresis phenomenon. For this reason, this type of lamps have not been suitable as light sources in industrial application machinery and apparatus for which there is required uniformity of luminance distribution.

On the other hand, as rare gas discharge lamps, a cold cathode type lamp has already been commercialized (HCB lamp, a product of Harrison Electrical Co., Ltd.). This lamp is of high luminance and high efficiency and is turned ON by means of a high frequency inverter of 25 kHz. It has non-temperature dependence and instantaneous stability which are peculiar to the rare gas discharge.

In this type of a rare gas discharge lamp, however, since the lamp current in cold cathode discharge cannot be enlarged, it is difficult to enhance the luminance so it has been impossible to meet the demand for higher luminance.

Further, there has been the problem that the handling of the lamp involves danger because the lamp voltage is very high.

The present invention has been effected for solving such conventional problems, and it is an object thereof to provide a lighting method for a hot cathode type low-pressure rare gas discharge lamp capable of affording high luminance and uniform luminance distribution, not requiring an increase of the lamp voltage and hence not involving danger in the handling of the lamp.

The said lighting method according to the present invention is characterized by lighting the lamp with a direct current.

A further embodiment of the present invention will be described below with reference to FIG. 8, which is a sectional view, partially in longitudinal section, of a hot cathode type low-pressure rare gas discharge lamp used in this embodiment.

Figure 8:
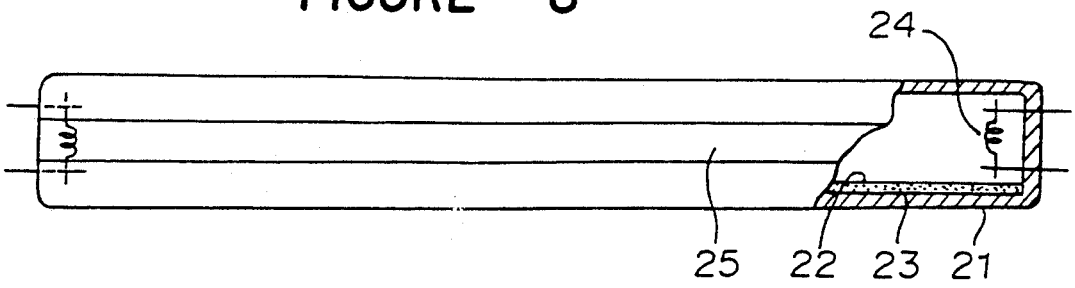
FIG. 8 is a side view, partially in longitudinal section, of a hot cathode type low-pressure rare gas discharge lamp according to a further embodiment of the present invention.

In FIG. 8, numerals 21, 22, 23, 24, and 25 denote a bulb, a fluorescent substance layer, a reflective film, an electrode, and a slit, respectively. The bulb 21 is a soda lime glass bulb having an outside diameter of 8 mm, with a pair of electrodes 24 being sealed to both end portions of the bulb. The distance between the electrodes is 260 mm. The electrodes 24 are hot cathode type electrodes using triple filament coils with an electron emitting substance applied thereto. The fluorescent substance layer 22 is formed by $Zn_2SiO_4Mn$ green fluorescent substance (a product of Kasei Optonix Ltd.). The reflective film 23 is formed between the fluorescent substance layer 22 and the bulb 21. The reflective film 23 and the fluorescent substance layer 22 are of an aperture type, each having a rectilinear slit 25 of 2 mm width in the tube length direction. Though not shown, a gaseous mixture of Xe 10% and Ne 90% is sealed as a light emitting gas into the bulb 21 at a pressure of 0.8 Torr, and an evaporation type barium getter is provided in the vicinity of the electrodes 24.

Figure 9:
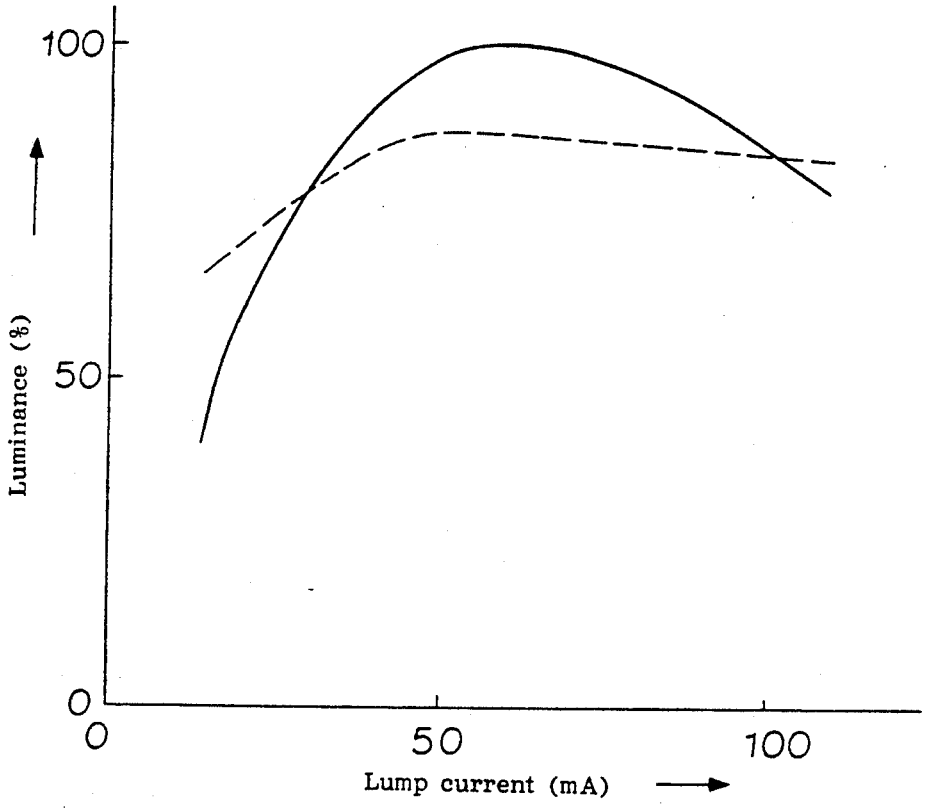
FIG. 9 is a graph showing changes in luminance relative to lamp currents in the cases of DC lighting and AC lighting.

FIG. 9 is a graph showing changes of luminance relative to lamp currents observed when the lamp was turned ON with direct current and when turned ON with alternating current. In the measurement of luminance, the values obtained centrally of the aperture at the center of the lamp were used. In DC lighting, both end leads of one side filament were short-circuited and used as anode. In the same figure, the solid line and dotted line represent DC lighting and AC lighting, respectively. In the measurement of luminance in AC lighting, the frequency of 65 kHz was fixed. The values of luminance shown are relative values, assuming that the luminance in 55 mA DC lighting is 100%.

As is apparent from the figure, at lamp currents of 100 mA or less at which the generation of heat usually causes no problem, the luminance is higher in DC lighting and there was a difference of 10% or more between maximum luminance values. The lamp current is an effective value, and the lamp voltage in DC lighting was higher about 30 volts than in AC lighting. Further, when the lamp was kept ON continuously for 1,000 hours at a lamp current of 50 mA, the cataphoresis phenomenon did not occur.

Although AC lighting has been explained with 65 kHz as an example, the same results were obtained also in the use of other frequencies. Further, for DC lighting, when a tungsten rod not applied with an electron emitting substance was provided on the anode side and a single lead was used, there were obtained the same results. Also as to the sealed gas, there were used rare gases and $N_2$ gas other than Xe, and the kind of the fluorescent substance layer and that of the reflective film as well as the shape of the aperture were changed, but the results obtained were the same.

According to the present invention, as set forth hereinabove, since the hot cathode type low-pressure rare gas discharge lamp is turned ON by direct current, it is possible to attain a high luminance which has been unattainable in AC lighting no matter how high the lamp current may be. Further, the cataphoresis phenomenon does not occur and hence it is possible to obtain a uniform luminance distribution.

Additionally, although the lamp voltage increases because direct current is used for lighting the lamp, no danger is involved in the handling of the lamp because the lamp voltage of the discharge lamp is usually low.

We claim:

1. In a low-pressure rare gas discharge lamp maintained at a pressure of less than 0.1 Torr, wherein a rare gas as a light emitting gas is sealed in a bulb and light emitted from the gas by electric discharge is utilized, the improvement characterized in that the light emitting gas is substantially 100% composed of selected rare gases and an isolation film for isolation of said light emitting gas in a discharge space preventing adverse influences caused by interaction of said light emitting gas with residues in said bulb, and thereby increasing an operation life span of said rare gas discharge lamp, wherein said isolation film is provided at least on the inner surface portion of the bulb which portion surrounds a positive column.

2. A low-pressure rare gas discharge lamp according to claim 1, wherein said isolation film is a thin titanium dioxide film ($TiO_2$) formed by thermal decomposition of tetrabutyl titanate, said thin titanium dioxide film having a light transmitting property.

* * * * *